United States Patent [19]

Conway

[11] 4,167,986

[45] Sep. 18, 1979

[54] FLUID STREAM SILENCING DEVICE

[75] Inventor: James R. Conway, Atlanta, Ga.

[73] Assignee: Adco, Ltd., Buford, Ga.

[21] Appl. No.: 885,861

[22] Filed: Mar. 13, 1978

[51] Int. Cl.[2] ..... E04F 17/04

[52] U.S. Cl. ..... 181/224

[58] Field of Search ..... 181/224, 243, 257, 279, 181/284, 286, 288, 293, 251, 252, 290, 214, 203; 138/40; 415/119

[56] References Cited

U.S. PATENT DOCUMENTS

| | | | |
|---|---|---|---|
| 1,648,708 | 11/1927 | Wilkinson | 138/40 |
| 1,756,626 | 4/1930 | Bourne | 181/279 |
| 2,270,825 | 1/1942 | Parkinson et al. | 181/224 |
| 2,959,243 | 11/1960 | Smith | 181/203 |
| 3,071,160 | 1/1963 | Weichbrod | 138/40 |
| 3,511,336 | 5/1970 | Rink et al. | 181/224 |
| 3,568,790 | 3/1971 | Sankey | 181/214 |
| 3,702,220 | 11/1972 | Medawar et al. | 415/119 |
| 4,109,750 | 8/1978 | Wirt | 181/224 |

*Primary Examiner*—L. T. Hix
*Assistant Examiner*—Benjamin R. Fuller
*Attorney, Agent, or Firm*—James B. Middleton

[57] ABSTRACT

A modular fluid stream silencing apparatus, primarily for use in air conditioning ducts and the like, comprising a plurality of air splitters formed of acoustical energy absorbing material, the air splitters being of such sizes that the plurality of air splitters can be installed within a duct centrally of the duct and coextensive with one another, additional air splitters which can be added to increase the size of the silencing apparatus for larger ducts, and a plurality of rods passing through the duct and the air splitters for mounting the air splitters, the preferred form of air splitters being annular and of such sizes to be mounted coaxially with one another.

6 Claims, 8 Drawing Figures

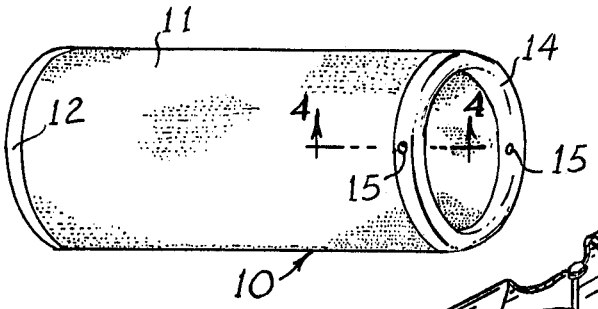
Fig. 1
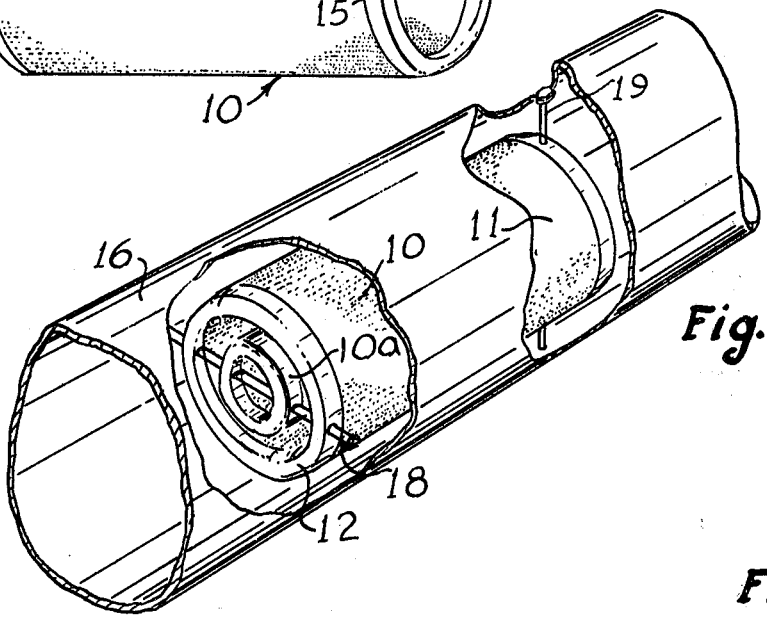
Fig. 2
Fig. 3
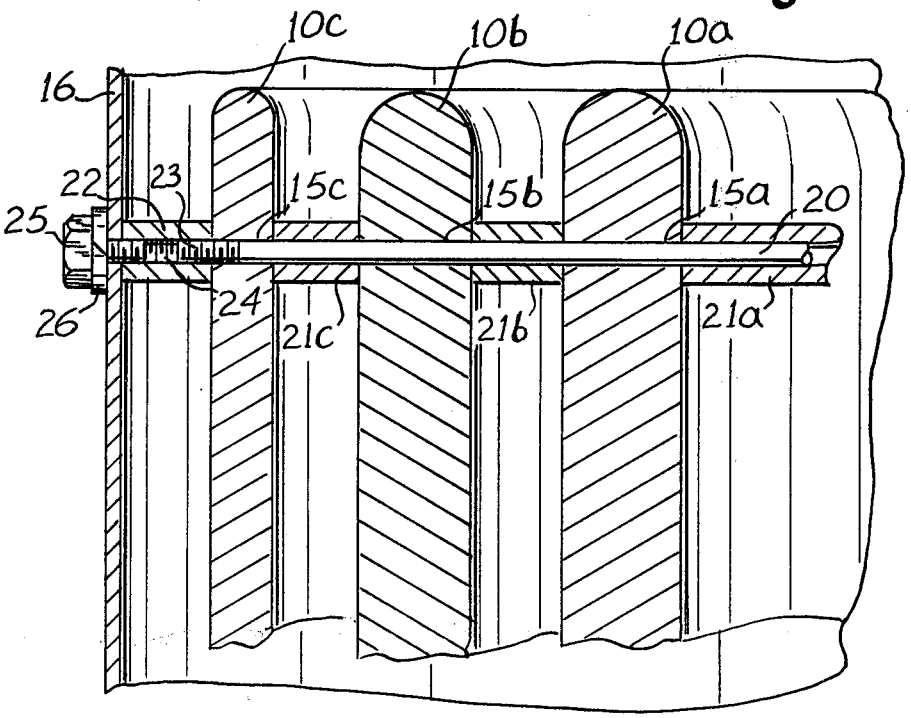

FLUID STREAM SILENCING DEVICE

This invention relates generally to silencing methods and apparatus, and is more particularly concerned with modular silencing apparatus for installation in a fluid stream.

There are many instances in which there is a fluid flow wherein the natural noise level caused by the flow of fluid is objectionable. Especially in veiw of the rather recent efforts at lowering the noise level to which people are subjected, some of the noise generated by fluid flow may be objectionable per se, and other noise may simply be noticed for the first time due to the increased awareness of noise levels. In any event, it is inherent in fluid flow streams that some noise is generated. More specifically, some of the energy of the fluid stream goes into extraneous vibrations, and some of these vibrations are in the frequency range that is audible to humans.

In the past there have been numerous efforts at silencing the noise from fluid flow systems, and these efforts have often taken the form of providing a tortuous path through which the fluid must flow. Such systems are most commonly used on high pressure systems wherein the tortuous path reduces the velocity of the fluid flow to decrease the amount of energy available for the production of noise. More recently there have been efforts to silence fluid streams by interposing energy-absorbing material into the fluid stream, the idea being to absorb energy and prevent its propagation as audible sound. While such devices, when properly constructed, are effective in reducing noises, they may cause an undesirably large pressure drop in the fluid flow system. Because of the necessity for careful construction of the silencing device to acheive a significant noise reduction without causing an intolerable pressure drop in the fluid system, most of the silencing apparatus of the energy absorbing type has been expensive to manufacture and to install. Furthermore, the prior devices have been of a relatively fixed design which was made in many different sizes to be used in pipes or ducts of different sizes, so a large inventory has been required in order to satisfy normal demands. An additional deficiency in the most common style of fluid flow silencer is that the silencer itself has a larger outside dimension than the pipe or duct with which the silencer is to be used. This results in the necessity for special transition pieces to adapt the large dimension of the silencer to the smaller dimension of the pipe or duct. Obviously, with such a system a section of the pipe or duct must be removed and the special section containing the silencing device must be installed in its place.

The present invention overcomes the above mentioned and other difficulties with the prior art silencing devices by providing a modular silencer which is installed completely within a duct or pipe of any given size. Due to its modular construction, the silencer made in accordance with the present invention is readily adaptable to virtually any size duct or pipe and is sufficiently variable to provide the desired degree or amount of silencing. More particularly, the silencer of the present invention includes a plurality of fixed-dimension splitters to be interposed in the fluid stream, the size and number of the splitters being selected in accordance with the size of the pipe carrying the fluid stream, and with the degree of silencing required. One feature of the present invention is that the fluid stream is diverted laterally to a minimum extent, thereby minimizing the pressure drop across the silencing device. In the preferred form of the invention, the splitters are annular in form and can be arranged within a duct coaxially with the duct and with one another, and held in place within the duct by a pair of rods of pins angularly disposed with respect to each other.

These and other features and advantages of the present invention will become apparent from consideration of the following specification when taken in conjunction with the accompanying drawing in which:

FIG. 1 is a perspective view of one annular splitter made in accordance with the present invention;

FIG. 2 is a perspective view of a plurality of splitters installed within a duct in accordance with the present invention;

FIG. 3 is an enlarged cross-sectional view taken through one of the mounting rods to show the construction thereof;

Figure 4:
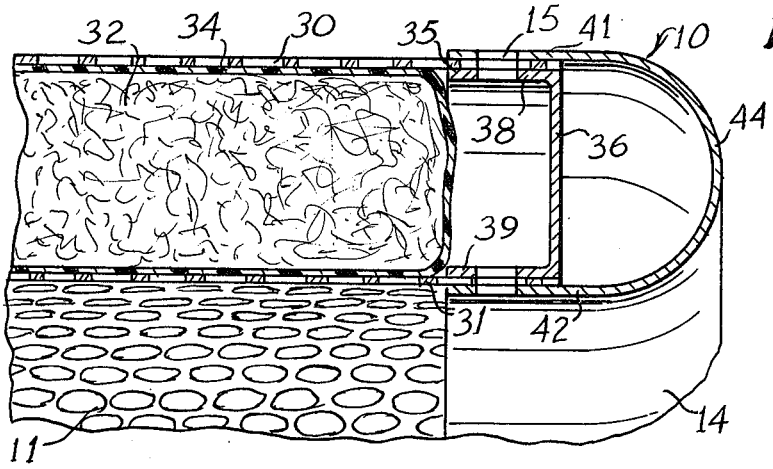
FIG. 4 is an enlarged cross-sectional view taken substantially along the line 4—4 in FIG. 1.

Referring now more particularly to the drawing and to those embodiments of the invention here chosen by way of illustration, it will be seen that FIG. 1 of the drawing depicts a single splitter designed for use in a fluid stream. The splitter 10 is cylindrical, having the body 11 formed of energy absorbing material, with end caps 12 and 14 formed into an appropriate aerodynamic shape to reduce fluid turbulence.

It should be understood by those skilled in the art that silencers such as those shown here, and to be discussed below, are generally usable in virtually any fluid stream to silence the audible sounds propagated by the fluid stream. Though there are some differences in treating various fluids, those skilled in the art will well understand those differences so that, for purposes of illustration, this discussion will be limited primarily to the silencing of the flow of air through ducts, such as for use in air conditioning and ventilation systems. It will be understood that such systems utilize relatively low pressures so that the intensity of sound propagated is relatively less than one might encounter in an extremely high pressure system.

Besides the intensity of sound, one must consider the frequency of sound. The principal difference in the silencing device as the frequency varies is that the length of the splitter varies, while the principal difference in the silencing device as the intensity varies is that the thickness of the energy absorbing material varies.

Returning to FIG. 1 of the drawing, it will be observed that, adjacent to the end cap 14 there is a pair of holes 15 located diametrically opposite each other. As will be seen shortly, these holes are adapted for mounting the splitter 10 within a duct.

Looking at FIG. 2 of the drawing, it will be seen that a first splitter 10 is mounted coaxially with a round pipe, or duct, 16. For some ducts, especially quite small pipe, the one splitter may be sufficient; however, as shown in FIG. 2 there is an additional splitter, here designated as 10*a*, mounted coaxially and coextensively therewith.

An important feature of the present invention is the ease of installation of the silencer of the present invention within a duct, and the installation means is shown generally in FIG. 2 of the drawing. Here it will be seen that, immediately beyond the end cap 12, a first mounting rod 18 extends diametrically through the splitter 10, and also extends diametrically through the pipe 16. At the opposite end of the splitters 10 and 10*a*, a second mounting rod 19 similarly extends through the splitters 10 and 10*a* and through the pipe 16. It should be noted that the rod 18 lies along a generally horizontal diameter as shown in FIG. 2, while the rod 19 lies along a generally vertical diameter. It will be realized that, with this simple expedient, the plurality of the splitters constituting the silencer are held from undesirable motion.

Attention is next directed to FIG. 3 of the drawing for a more detailed understanding of the mounting rods 18 and 19, and the means for retaining a plurality of splitters within a duct. It will here be seen that a plurality of splitters 10*a*, 10*b* and 10*c* have appropriate diametrical holes 15*a*, 15*b* and 15*c* through which a pin 20 passes. The pin 20 is of a size just sufficient to be received within the holes 15 and is of a length to be received within the pipe 16, diametrically thereof.

Though the arrangement wherein the pin 20 passes through holes in the splitters would prevent motion in one direction, some means may be required to prevent motion of the splitters along, i.e. longitudinally of, the pin 20. In some installations it may be that the angularly disposed arrangement of the two rods as shown in FIG. 2 will be sufficient to prevent motion of the splitters. It will be realized that, for one end of the splitter to move longitudinally of the pin, the opposite end must have enough space that the splitter can cant with respect to the pin. With close tolerances this would not be possible and the arrangement of FIG. 2 would be sufficient in itself to hold the splitters in the proper position within the duct.

Nevertheless, it may frequently be desirable to provide additional assurance that the splitters will not move longitudinally of the rod, and such structure is shown in detail in FIG. 3 of the drawing. Thus, the pin 20 passes diametrically of the pipe 16 and diametrically through each of the splitters 10*a*, 10*b*, and 10*c*, and there is a spacing sleeve 21 received over the pin 20 between the splitters. As here shown, there is a sleeve 21*a* within the splitter 10*a*, a sleeve 21*b* between the splitter 10*a* and the splitter 10*b*, and a sleeve 21*c* between the splitter 10*c* and the splitter 10*b*. Each of the sleeves 21*a*, 21*b* and 21*c* has a central bore to receive pin 20, and has an outside diameter larger than the holes 15*a*, 15*b* and 15*c* so the sleeves can effectively act as spacers to hold the splitters 10*a*, 10*b*, and 10*c* postively in place.

The outermost spacing means shown in FIG. 3 performs a dual function. The spacing means 22 must be the proper length to extend between the largest splitter 10*c* and the pipe 16. This spacing means 22 has a central bore which is threaded as indicated at 24. To cooperate with the threaded bore 24, the ends of the pin 20 are threaded as shown at 23. Thus, with the pin 20 passing through the plurality of splitters, and the sleeves 21 in place, the spacing means, or spacer nut, 22 can be threaded onto the end of the pin 20 to hold the assembly together.

It will further be seen that the threaded bore 24 extends entirely through the spacer nut 22. As a result, a screw 25 can be passed through the wall of the pipe 16, by means of an appropriate aperture, and threaded into the spacer nut 22 to hold the assembly in place within the pipe 16. As here shown, there is also a lock washer 26 between the wall of the pipe 16 and the screw to prevent inadvertent loosening of the screw 25 during the normal vibrations that tend to be inherent in duct work.

From the foregoing it will be seen that sleeves 21 can be made in standard lengths to cooperate with standard diameters of splitters 10. Also, the spacer nuts 22 can be made in various standard lengths based on the diameter of the splitters and standard pipe diameters. With a relatively small range of lengths of spacers or sleeves 21 and spacer nuts 22, it will readily be seen by those skilled in the art that virtually any desired number of splitters 10 can be installed within a pipe 16 with little effort. One must simply provide diametrically opposed holes in the pipe 16 in one location for the rods, such as the rod 19, and in another location for the rods such as the rod 18. The silencer can then be assembled completely, omitting only the final screws 25. In this assembled state, the silencer can be placed into the duct 16, the spacer nuts 22 aligned with the appropriate holes, and the screws 25 with the appropriate washers 26 placed to secure the silencer within the duct.

Attention is next directed to FIG. 4 of the drawing which illustrates in detail the construction of one form of splitter made in accordance with the present invention.

First, it should be understood that silencing devices presently made and sold for duct work and the like are frequently constructed of perforate metal, the perforate metal being used as wall members which contain a volume of sound absorbing material such as fibrous material or the like.

FIG. 4 of the drawing shows a splitter 10 having an outer cylindrical wall 30 and a parallel, inner cylindrical wall 31, both walls 30 and 31 being formed of perforate metal of the type well known in the art. It will be seen that, between the walls 30 and 31 there is a volume of sound absorbing material, the material 32 being here illustrated only as fibrous material. It is well understood in the art that sound absorbing material is simply material having a very low elasticity so that sound energy is absorbed by the material and dissipated rather than reflected.

As here illustrated, the fibrous, sound absorbing material 32 is contained within an envelope 34. It will be understood that many different arrangements may be used to contain the material; and, in some instances a generally solid material having sufficient integrity not to require an envelope may be used. In any event, if a generally loose fibrous material is to be used as the sound absorbing material 32, the material may be placed within an envelope 34 to prevent the loss of fibers through the perforate walls 30 and 31.

To maintain the walls 30 and 31 in their appropriate spaced relationship, the ends of the walls receive a channel 35 therebetween. The channel 35 has a central web 36 and arms 38 and 39 which extend parallel to and contiguous with the walls 30 and 31. It will therefore be seen that the channel 35 closes the open end of the space between the walls 30 and 31, and provides spacing means whereby the two cylindrical members 30 and 31 are held apart. Additionally, it will be understood that the channel 35 can be welded or otherwise fixed to the walls 30 and 31 to render the device integral.

The end cap 14 shown in FIG. 4 of the drawing is similar to the channel 35 as viewed in FIG. 4, and is arranged to telescope over the channel 35. In more detail, it will be seen that the end cap 14 is designed to provide the desired aerodynamic configuration to the end of the splitter 10. The end cap 14 shown in FIG. 4 of the drawing includes a pair of legs 41 and 42 which overlie the legs 38 and 39 of the channel 35, it being understood that the legs 41 and 42 are joined by a hemi-toroidal member 44, which appears semi-circular in FIG. 4 of the drawing.

Those skilled in the art will understand that fluid flow around a circular configuration as shown in FIG. 4 of the drawing is a very smooth flow with little or no turbulence. This is especially true if the fluid flow is in a direction to impinge on the member 44 and then flow along the legs 41 and 42 and down to the body 11 of the silencer 10. Those skilled in the art will similarly be aware that, when the fluid flow is in the opposite direction so that fluid flows along the walls 30 and 31, then leaves the device by flowing around the arms 40 and 41 and then away from the end cap 14, there will be some fluid turbulence adjacent to the end cap 14. In many cases this turbulence will be sufficiently slight that it can be tolerated. As a result, it is contemplated that end caps constructed as shown in FIG. 4 of the drawing will be used on both ends of the splitter 10, that is as both end cap 12 and end cap 14. This has the desirable result that the splitter may be installed in either direction in the duct without varying the aerodynamic pattern of fluid flow over the silencer. Nevertheless, if the turbulence due to the fluid's leaving the end cap 14 is too great to be tolerated in the particular system, a different configuration of end cap can be installed to provide less turbulence.

Figure 5:
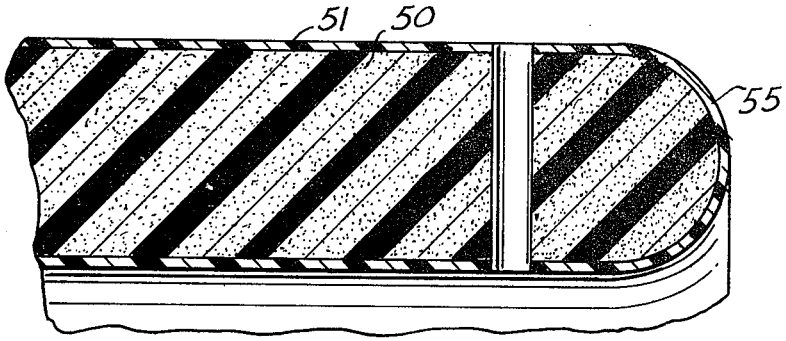
FIG. 5 is a view similar to FIG. 4 but showing a modified form of construction of a splitter.

FIG. 5 of the drawing shows a modified construction of the splitter, though the shape of the air splitter and the function thereof are substantially the same as for the construction shown in FIG. 4 of the drawing. The splitter shown in FIG. 5 of the drawing includes a relatively solid body of material 50, the material in itself having sound absorbing properties. Those skilled in the art will understand that numerous materials may be used, including the conventional pressed fiber material. As here contemplated, the material 50 is an expanded plastic material such as polystyrene, polyethylene, polyether or the like. Surrounding the body of material 50 there is an envelope 51 to contain the material and prevent gradual erosion of the material, which would be undesirable both from the standpoint of losing the sound absorbing material and from the standpoint of having material entrained in the fluid stream.

On construction to provide the body of material 50 and the envelope 51 would be to utilize a material such as expanded polystyrene as the body 50, the polystyrene being shaped into the desired configuration as shown in FIG. 5 of the drawing. After the polystyrene has been appropriately shaped, the entire device could be encased in an envelope of sheet material, the sheet material being made of polyethylene, polyvinylchloride or other material that could surround the polystyrene body. Alternatively, however, it would be understood that the envelope 51 may be formed through the use of a self-skinning material such as expanded polyethylene, or one of the many self-skinning polyethers, polyurethane or the like.

As with the embodiment of the invention shown in FIG. 4 of the drawing, it will be understood that the splitter shown in FIG. 5 can have the end 55 formed in a desired aerodynamic configuration. It is here shown as hemi-toroidal as in FIG. 4, and it is contemplated that both ends of a splitter made in accordance with the embodiment shown in FIG. 5 of the drawing would be hemi-toroidal in shape.

Figure 6:
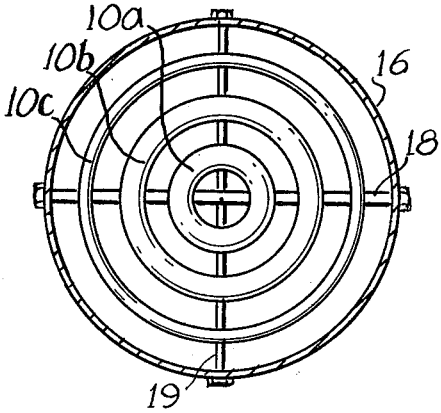
FIG. 6 is an end elevational view of a plurality of splitters installed within a duct in accordance with the preferred embodiment of the present invention.

Looking now at FIG. 6 of the drawing, it will be seen that the splitters of the present invention formed as described above would be placed within a pipe or duct 16 concentrically with one another, The splitters in FIG. 6 are denoted at 10*a*, 10*b* and 10*c*, and it will be understood that additional splitters may be used if desired, depending on the size of the pipe 16. Also, it will be seen in FIG. 6 of the drawing that the support rods 18 and 19 extend diametrically of the pipe 16, and diametrically of the concentric air splitters 10*a*, 10*b* and 10*c*.

Figure 7:
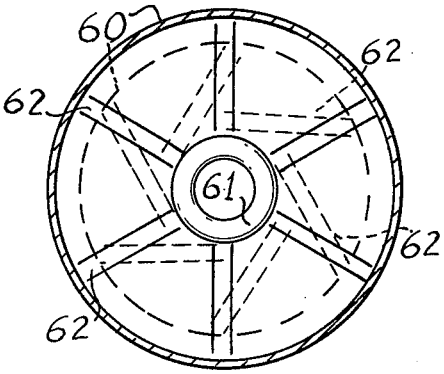
FIG. 7 is a view similar to FIG. 6 but showing a modified arrangement of splitters in accordance with the present invention; and, FIG. 8 is a view similar to FIGS. 6 and 7 but showing a plurality of splitters installed within a rectangular duct in accordance with the present invention.

Looking at FIG. 7 of the drawing it will be seen that a modified form of the invention is shown wherein there is a pipe designated at 60, and a cylindrically shaped splitter 61 is disposed coaxially with the pipe 60. Extending radially from the splitter 61 is a plurality of flat, planar, splitters. It is contemplated that the radial splitters 62 will be hingedly connected to the cylindrical splitter 61 so that the single silencer shown in FIG. 7 can be used for a plurality of sizes of pipe such as the pipe 60. As is shown by the broken line representation in FIG. 7, when a smaller size pipe 60 is to receive the silencer, the splitters 62 would be hinged with respect to the cylindrical splitter 61 to lie in the position shown in the broken lines, thereby reducing the outside diameter of the silencer.

Figure 8:
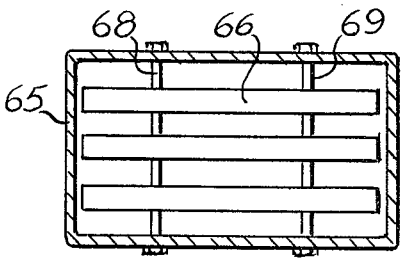

Another embodiment of the invention is shown in FIG. 8 of the drawing, FIG. 8 illustrating a rectangular pipe or duct 65 having a plurality of splitters 66 arranged within the pipe 65 parallel to one another and parallel to two of the walls of the pipe 65. Mounting rods 68 and 69 extend through the splitters 66 and through the walls of the duct 65. It will of course be understood that the construction of the rods 68 and 69 is the same as the construction of the rods 18 and 19 as more specifically shown in FIG. 3 of the drawing. Thus, it will be understood that there would be spacer sleeves between each of the splitters 66, and spacer nuts between the endmost spacer 66 and the walls of the duct 65.

The construction of the silencer of the present invention having been discussed above, the operation of the device will now be described.

It should first be realized that, while sound is conventionally represented as a sine curve, the physical makeup of sound is a band of relatively high pressure followed by a band of relatively low pressure. In high pitched, or high frequency, sounds the bands of high and low pressure are relatively narrow and close together, while in low frequency, or low pitched, sounds, the bands are relatively wide and spaced apart. Thus, if one is to silence sound through the use of sound absorbing material, one must interpose sound absorbing material in the path of the sound in such manner that the high pressure bands expend their energy in compressing the inelastic material. It should be understood that it is the difference in pressures between the high pressure and low pressure bands that provides the volume of sound so that if the high pressure is diminished with respect to the low pressure to yield a very small difference in pressures, there will be very little sound propagated. An energy absorbing silencer for a fluid stream must be long enough that the full width of the band of high pressure will engage the energy absorbing material. For high frequency sound this is no problem because the bands are so narrow; but, for very low frequency sounds the band may be considerably wider than the total length of the silencing device.

It will be seen that the silencer of the present invention allows the total fluid stream to be split, or divided, using energy absorbing material. The construction of the silencer of the present invention is such that a single air splitter may be used for relatively small pipes or ducts, and additional splitters can be added coaxially with the first for larger pipes or ducts. It will of course be recognized that the splitters such as the splitters 10*a*, 10*b*, 10*c* etc. can be made with a wall thickness as desired for the degree of silencing required for the particular installation. It is contemplated that the silencers will have a wall thickness of approximately two inches, or approximately 5 centimeters, in thickness. This thickness will provide sufficient sound absorption in most systems, assuming a plurality of sound absorbing splitters is used as shown in FIG. 2 and FIG. 6 of the drawing, but the fluid stream will not be diverted laterally to an excessive extent.

A requirement for greater lateral motion of the moving fluid stream will remove more of the energy and cause greater pressure drop over the silencer whereas a smaller lateral motion will cause a smaller pressure drop. In many cases, it may be desirable to make the air splitters, or at least some of them, with a wall thickness of about one inch, or about 2.5 centimeters. These thinner walled splitters can be used when the space remaining in the pipe is too large to remain undivided, but too small to allow use of the two-inch thick splitter.

In the installation of a silencer of the present invention, it will therefore be seen that one would select the appropriate sizes of splitters 10 and the appropriate number of such splitters, and would assemble them using rods such as rods 18 and 19. With the rods 18 and 19 appropriately installed in the plurality of individual splitters 10, there will be a unitary assembly that can be inserted into a pipe or duct. With proper holes drilled into the duct, the silencing assembly can be placed into the duct, and screws 25 can be threaded into the spacer nuts 22 to secure the silencer in place within the duct.

In the event the frequency of the sound to be silenced is low, which is to say that the bands of high pressure are very wide, the length of the silencer may need to be longer than the single unit of splitters. In this event, two or more of the splitters can be placed end to end to give the effective length required for the particular installation. In this connection, it is contemplated that the splitters 10 would be made in lengths of 3 feet and 4 feet, or perhaps one meter and 1.3 meters, so that two or more of the splitters can be placed end to end to achieve any length desired.

It will therefore be seen that the present invention provides a highly flexible but highly effective silencing device for fluid streams, the silencing device being modular in construction to be easily adpated to almost any installation. It will of course be understood that the particular embodiments of the invention here shown are by way of illustration only, and are meant to be in no way restrictive; therefore, numerous changes and modifications may be made, and the full use of equivalents resorted to, without departing from the spirit or scope of the invention as defined in the appended claims.

I claim:

1. Silencing apparatus for a fluid stream flowing through a pipe longitudinally of said pipe, said silencing apparatus including a plurality of fluid stream splitters formed of acoustical energy absorbing material, characterized in that said plurality of fluid stream splitters are generally cylindrical annular members, mounting means for fixing a plurality of said fluid stream splitters coaxially with one another and coextensive with one another to from said silencing apparatus, said silencing apparatus having an outside diameter less than the inside diameter of said pipe so that said silencing apparatus is receivable within said pipe longitudinally thereof and coaxial therewith, said mounting means further including spacer means for selectively retaining said silencing apparatus coaxial with said pipe, said mounting means comprising a pin extendable generally diametrically through said silencing apparatus, a plurality of spacing sleeves surrounding said pin for retaining said splitters in position along said pin, said spacer means being selectable to extend from said pin to the wall of said pipe.

2. Silencing apparatus as claimed in claim 1, and further characterized by additional splitters disposable coaxial and coextensive with said plurality of splitters for increasing the outside dimension of said silencing apparatus.

3. Silencing apparatus as claimed in claim 1, characterized by a second pin extending diametrically through said plurality of splitters, said second pin being angularly disposed with respect to said first pin and longitudinally spaced therefrom.

4. Silencing apparatus as claimed in claim 3, characterized in that each splitter of said plurality of splitters comprises an inner cylindrical wall, an outer cylindrical wall coaxial and coextensive with said inner cylindrical wall, acoustical energy absorbing means between said inner cylindrical wall and said outer cylindrical wall, and at least one end of said splitter is aerodynamically shaped for reducing fluid turbulence.

5. Silencing apparatus as claimed in claim 4, characterized in that said inner cylindrical wall and said outer cylindrical wall are formed of perforate sheet material, said acoustical energy absorbing material comprises fibrous material, and there is an envelope for containing said fibrous material, and an end cap covering the space between said inner cylindrical wall and said outer cylindrical wall, said end cap constituting said end aerodynamically shaped.

6. Silencing apparatus as claimed in claim 5, characterized by a channel between said inner cylindrical wall and said outer cylindrical wall, said channel including a web, and a pair of arms extending along said walls, said arms defining holes therethrough for receiving said mounting means, said end cap having a pair of arms partially overlying said pair of arms of said channel, said end cap being formed as a hemi-toroid to reduce fluid turbulence.

* * * * *